United States Patent [19]

Digne et al.

[11] Patent Number: 4,761,793

[45] Date of Patent: Aug. 2, 1988

[54] PLASMA FIRED FEED NOZZLE

[75] Inventors: Shyam V. Digne, North Huntingdon; Charles B. Wolf, Irwin, both of Pa.

[73] Assignee: Electric Power Research Institute, Palo Alto, Calif.

[21] Appl. No.: 47,811

[22] Filed: May 8, 1987

[51] Int. Cl.[4] ..... H05H 1/26

[52] U.S. Cl. ..... 373/24; 219/121.48; 219/121.5; 219/121.51; 219/121.37

[58] Field of Search ..... 373/24, 22, 18; 219/121 P, 122 PA, 121 PM, 121 PP, 121 PQ

[56] References Cited

U.S. PATENT DOCUMENTS

| | | | |
|---|---|---|---|
| 4,530,101 | 7/1985 | Fey et al. | 373/24 |
| 4,554,435 | 11/1985 | Wolf et al. | 373/18 |
| 4,611,332 | 9/1986 | Santen | 373/24 |

OTHER PUBLICATIONS

"Test Results on a Pilot-Scale Plasma-Fired Cupola for Iron Chip Melting" Dighe, et al.

*Primary Examiner*—Roy N. Envall, Jr.
*Attorney, Agent, or Firm*—Fred J. Boehr, Jr.

[57] ABSTRACT

A plasma feed nozzle 3 for a furnace 1 which has a tubular mixing chamber 7 open at one end to the furnace, a plasma torch 13 which provides superheated gases axially to the central portion of the mixing chamber 7, shroud gases which enter the end of the mixing chamber opposite the end open to the furnace in such a way as to swirl as it moves axially through the mixing chamber 7 to provide a temperature profile which is substantially hotter in the central portion of the mixing chamber 7 than adjacent the wall portion thereof and a particulate feed nozzle 25 disposed to direct particulate material to the central portion of the mixing chamber.

15 Claims, 7 Drawing Sheets

PLASMA FIRED FEED NOZZLE

BACKGROUND OF THE INVENTION

This invention relates to a feed nozzle for a furnace and more particularly to a plasma feed nozzle for a cupola. As described in U.S. Pat. No. 4,530,101 by M. G. Fey and T. N. Meyer, heat from an electric arc can be fed into a cupola or other furnace to enhance the operation thereof by providing a very hot gas stream which may be either oxidizing or reducing and can also be mixed with particulate material. The electric arc is produced in a plasma torch in which the electric arc ionizes the gas which is blown out of the end of the torch producing a white hot gas stream which generally operates in the range of 10,000° F. or 5,538° C. Such temperatures are maintained for hours or days in a relatively small diameter feed nozzle without destroying the refractory material which line the nozzle. Refractory material normally begins to soften about 2,900° F. or 1595° C. about one-third of the temperature of the superheated gas stream from the plasma torch.

Particulate material fed into the superheated stream melts rapidly providing expeditious rapid changes to the chemistry of molten metal in a cupola or other type of furnace.

SUMMARY OF THE INVENTION

In general, a plasma torch feed nozzle for a furnace, when made in accordance with this invention, comprises a plasma torch for producing a superheated gas at a temperature in the range of 10,000° F. or 5538° C., a conduit for shroud gas; a tubular mixing chamber in fluid communication with the superheated gas and the conduit for shroud gas and has one end open to the furnace. The mixing chamber is lined with refractory material and is generally encircled by a cooling fluid jacket. The superheated gas from the plasma torch and the shroud gas from the conduit are introduced into the mixing chamber in such a manner that the temperature profile of the gases is substantially hotter in the central portion of the mixing chamber than adjacent the refractory lining as the gas flows axially through the mixing chamber and into the furnace.

BRIEF DESCRIPTION OF THE DRAWINGS

The objects and advantages of this invention will become more apparent by reading the following detailed description in conjunction with the accompanying drawings, in which.

DESCRIPTION OF THE PREFERRED EMBODIMENTS

Figure 1:
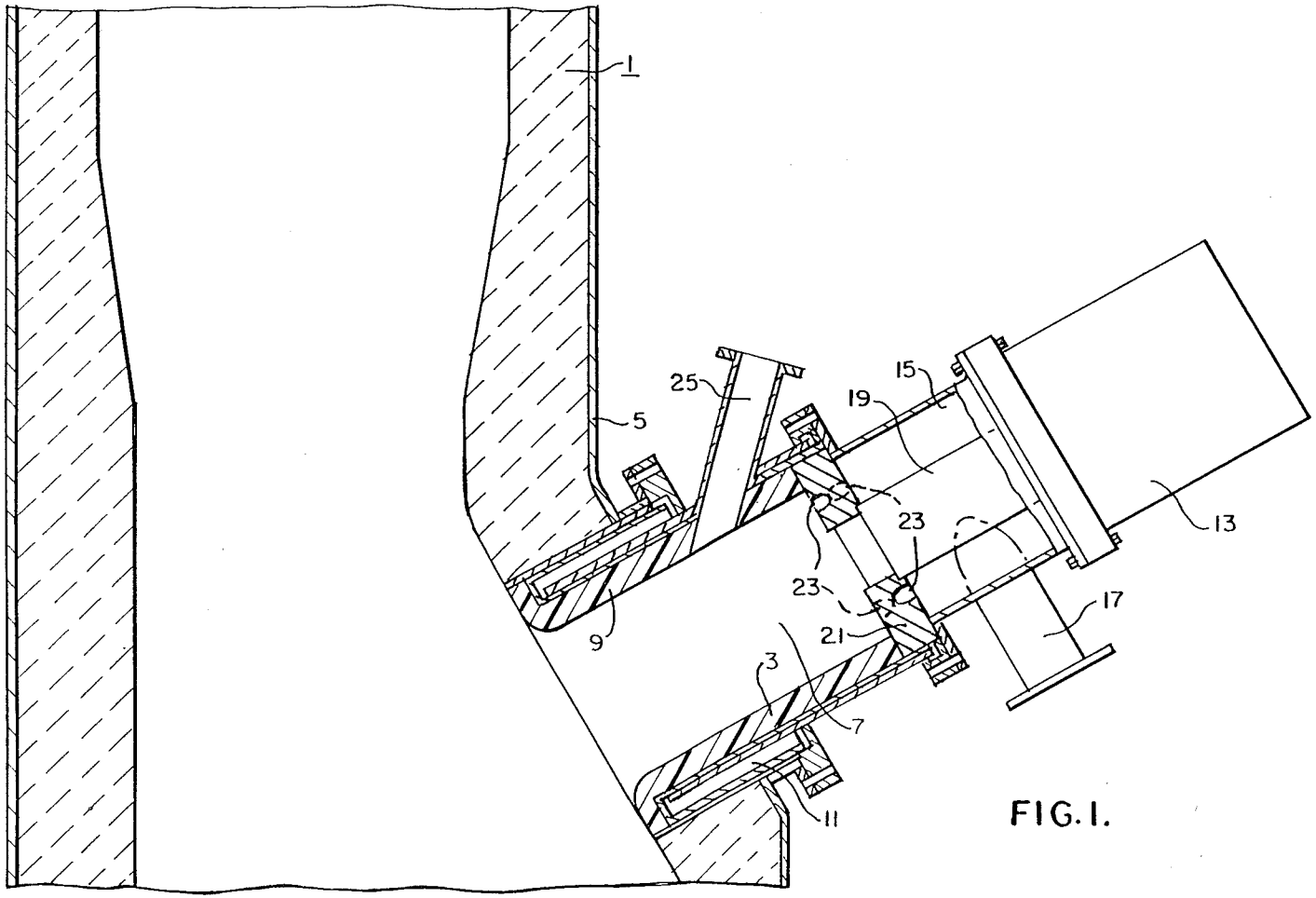
FIG. 1 is a partial sectional view of a cupola with a plasma fired nozzle disposed therein.

Referring now to the drawings in detail and in particular to FIG. 1 there is shown a portion of a furnace such as a cupola 1 with a plasma feed nozzle or tuyere 3 attached to a side wall 5 thereof. The feed nozzle 3 comprises a tubular mixing chamber 7 lined with one or more layers of refractory 9 and encircled by a cooling jacket 11 through which a cooling fluid such as water is passed. The mixing chamber 7 has one end thereof open into the furnace 1. A plasma torch 13 is disposed in the end of the mixing chamber 7 opposite the end opening into the furnace. Also disposed on the end of the mixing chamber opposite the end opening into the furnace is a plenum chamber 15.

Shroud air or process gas is introduced into the plenum chamber 15 preferably through a shroud gas inlet nozzle 17 tangentially disposed with respect to the plenum chamber 15. The plasma torch 13 such as the Marc 11 manufactured by Westinghouse Electric Corporation has a plasma nozzle 19 which extends through the plenum chamber 15 to provide a blast of flame-like superheated gas to the central portion of the mixing chambers 7. The temperature of the superheated gas entering the mixing chamber is generally in the range of 10,000° F. (5,538° C.).

As shown in FIG. 1 there is a refractory separator 21 disposed between the mixing chambers 7 and the plenum chamber 15 with a plurality of inclined ports 23 disposed to introduce the shroud gas into the mixing chambers 7 in such a manner that the shroud gas swirls as it progresses axially through the mixing chamber 7 and the superheated gas from the plasma torch 13 is introduced along the axis of the mixing chamber 7 also swirling so that a gas temperature profile across the mixing chamber 7 is substantially hotter in the central portion thereof than adjacent the refractory walls 9.

A particulate material feed nozzle 25 is disposed in fluid communication with the mixing chamber 7 and the axis thereof forms an acute angle with the axis of the mixing chamber 7 the angle being determined by the density, size, velocity and viscosity of the particulate material and transporting fluid which is adjusted to direct the influent feed material to the central portion of the mixing chamber 7 where the temperature is the hottest to rapidly raise the temperature of the influent particulate material.

Figure 2:
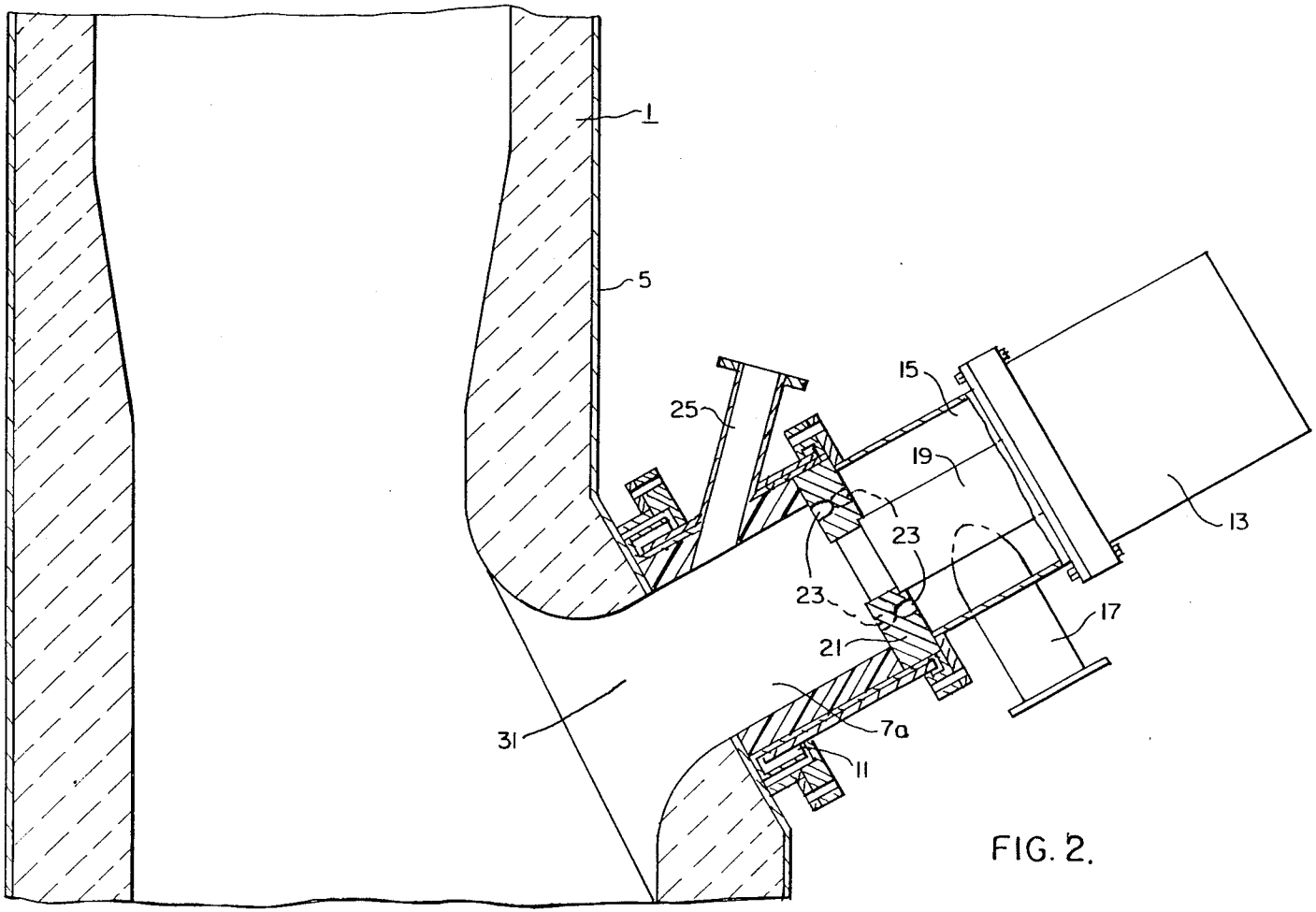
FIG. 2 is an alternative embodiment of the cupola with a plasma fired nozzle diposed therein.

As shown in FIG. 1 the mixing chamber 7 may extend at least partially through the refractory lining of the furnace or as shown in FIG. 2, the mixing chamber may abut the furnace's outer wall when there is an opening 31 in the furnace wall and refractory lining 5 which registers with the open end of the mixing chamber 7*a*.

Figure 3:
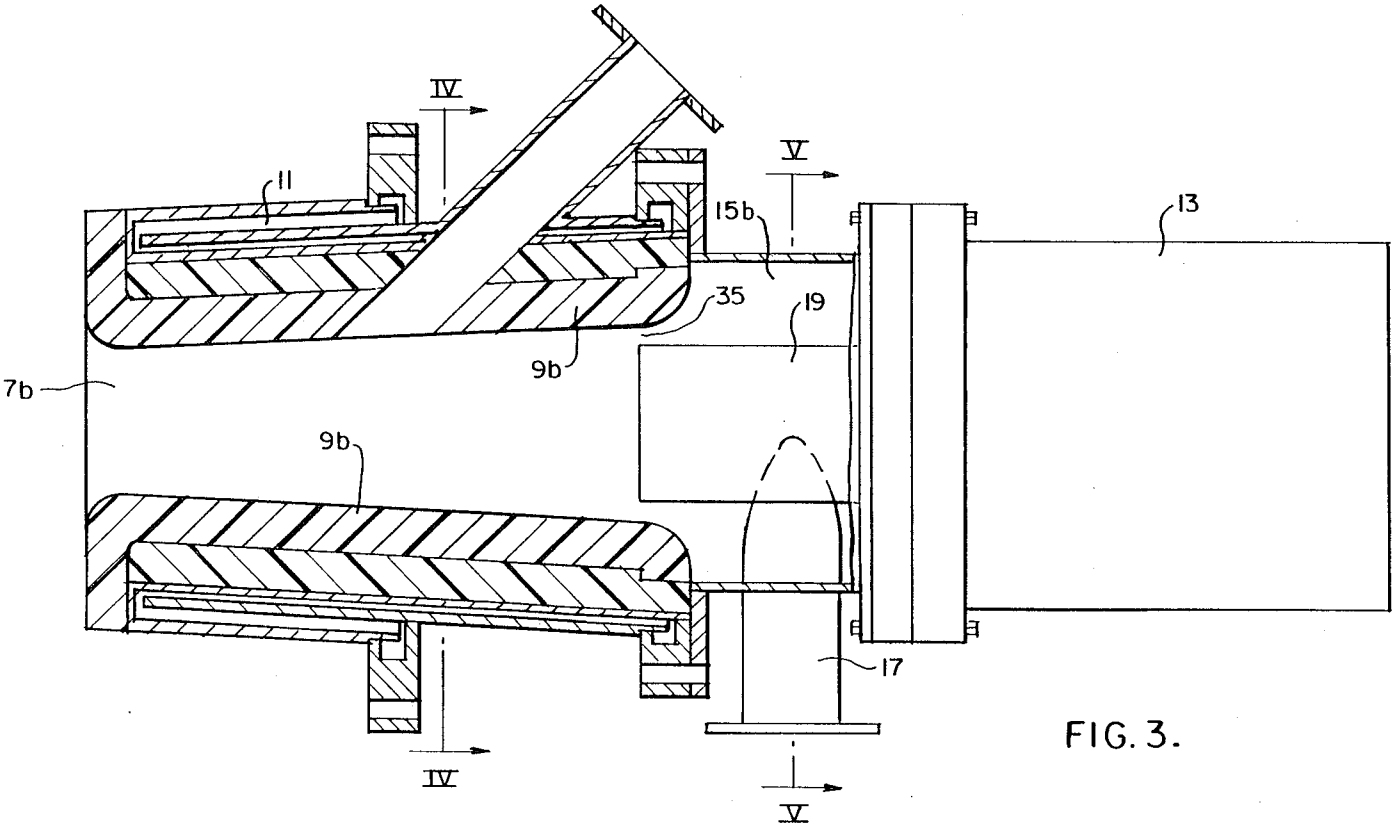
FIG. 3 is an enlarged section view of the nozzle.
Figure 5:
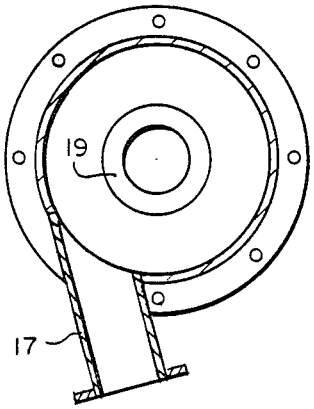
FIG. 5 is a sectional view taken on line V—V of FIG. 3.
Figure 6:
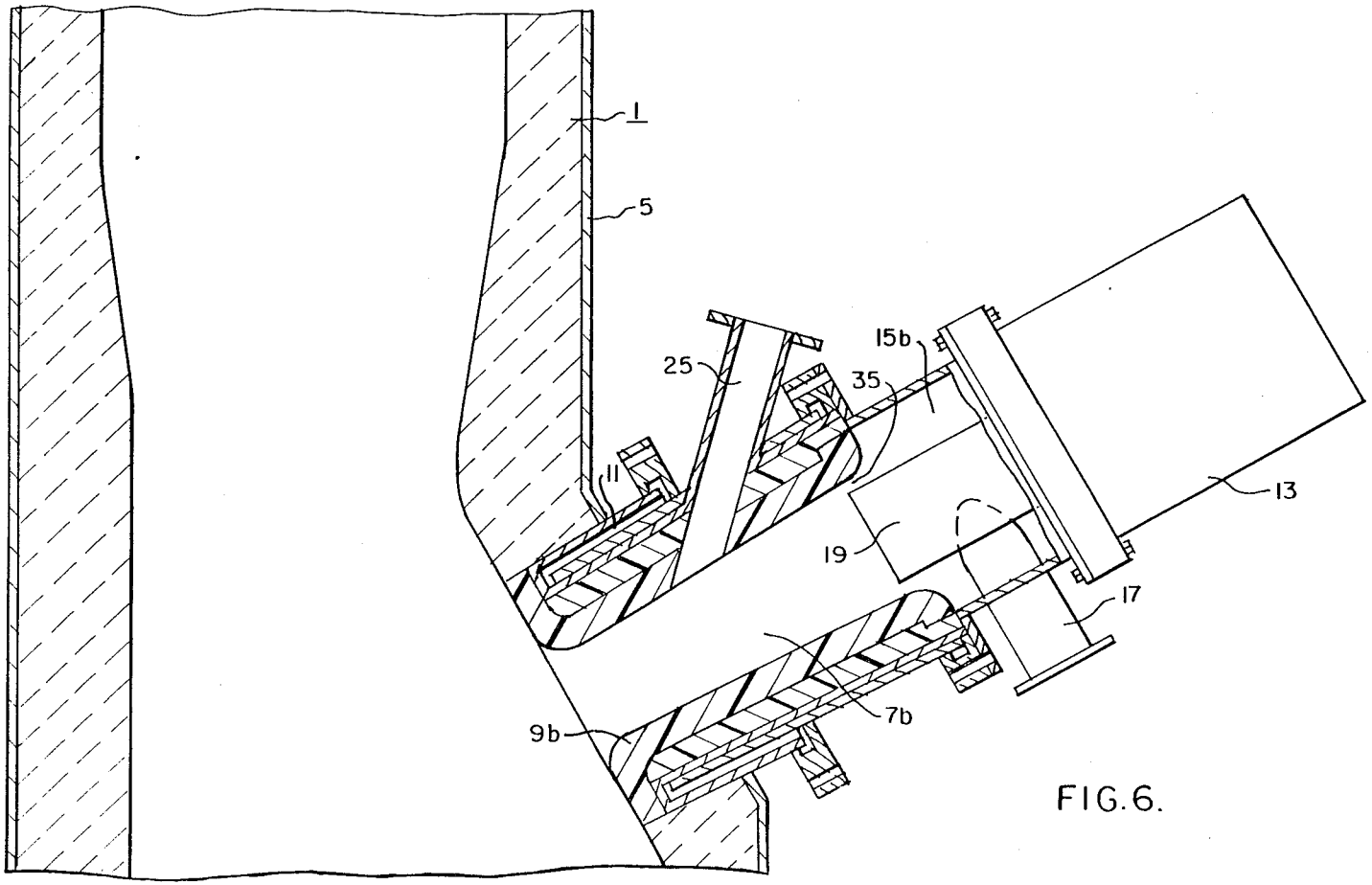
FIG. 6 is an alternative embodiment of the cupola with a plasma fired nozzle shown in FIG. 3 disposed therein.

As shown in FIGS. 3 and 6, the mixing chamber 7*b* may be made with walls which taper inwardly toward the open end and there is no separator wall between the plenum chamber 15*b* and the mixing chamber 7*b*, but there is an annular opening 35 between the refractory wall 9*b* and the nozzle 19 of the plasma torch 13. Te tangentially disposed shroud gas nozzle 17 as shown best in FIG. 5 provides a swirling motion to the shroud gas entering the plenum chamber 15 producing a temperature profile across the mixing chamber 7b which is substantially hotter in the central portion thereof than adjacent the refractory walls 9b. The refractory walls 9b of the mixing chamber 7b may be made of two or more refractory liners facilitating replacement of the inner lining which is subject to wear.

Figure 4:
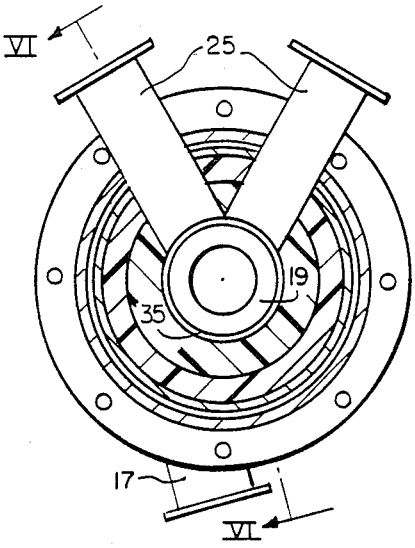
FIG. 4 is a sectional view taken on line IV—IV of FIG. 3.

There may be a plurality of feed material nozzles 25 as shown in FIG. 4, each of which is disposed to form a predetermined acute angle with the axis of the mixing chamber 7b to direct the material to the central portion of the mixing chamber where the temperature is the hottest.

Figure 7:
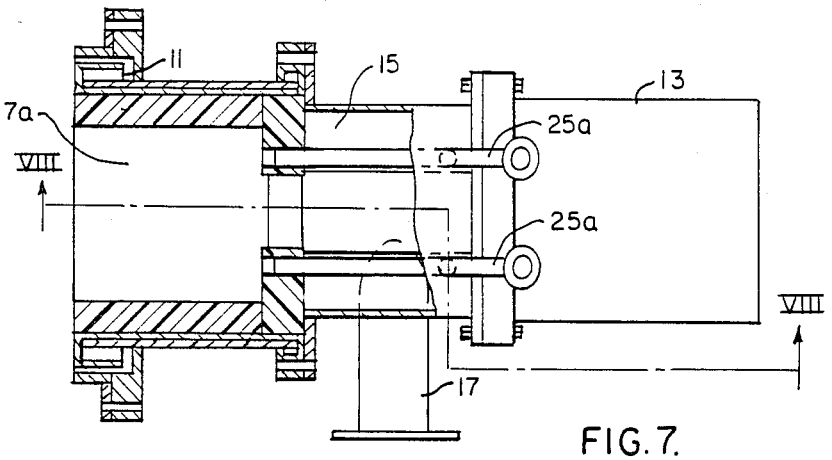
FIG. 7 is an alternative embodiment of the nozzles shown in FIG. 2.
Figure 8:
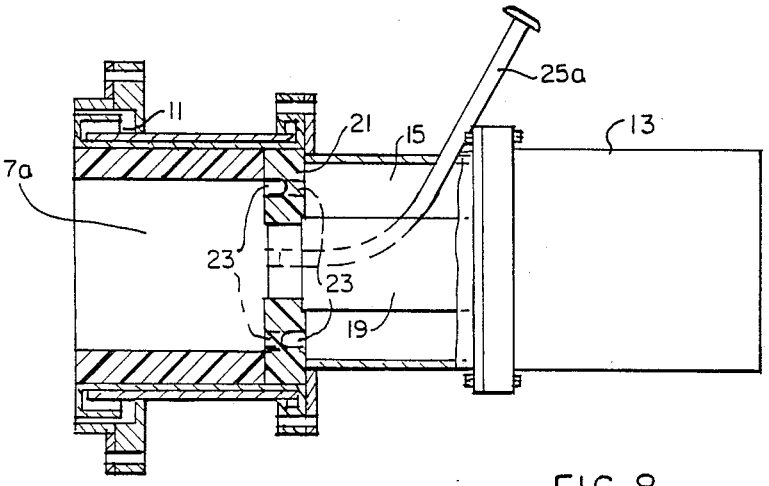
FIG. 8 is a sectional view taken on line VIII—VIII of FIG. 7.

FIGS. 7 and 8 show a mixing chamber *7a*, plenum chamber 15 and separator 21 similar to those shown in Fig. 2 with the exception that the feed nozzles 25a extend through the separator 21 on either side of the plasma nozzle 19 generally parallel to the axis of the mixing chamber.

Figure 9:
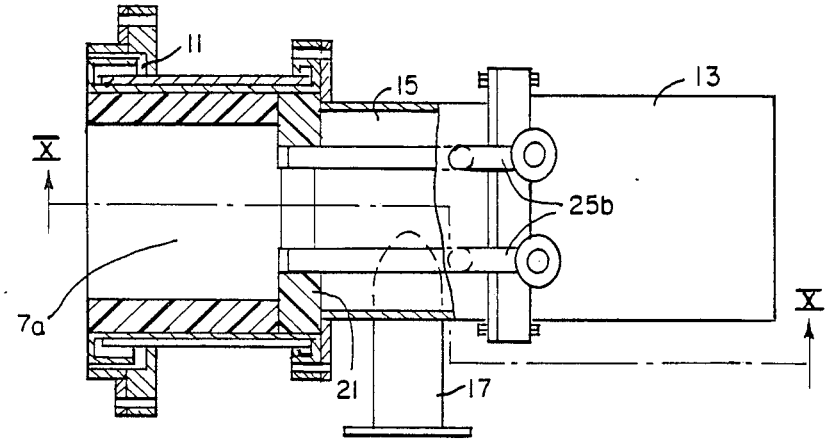
FIG. 9 is an alternative embodiment of the nozzle shown in FIG. 7.
Figure 10:
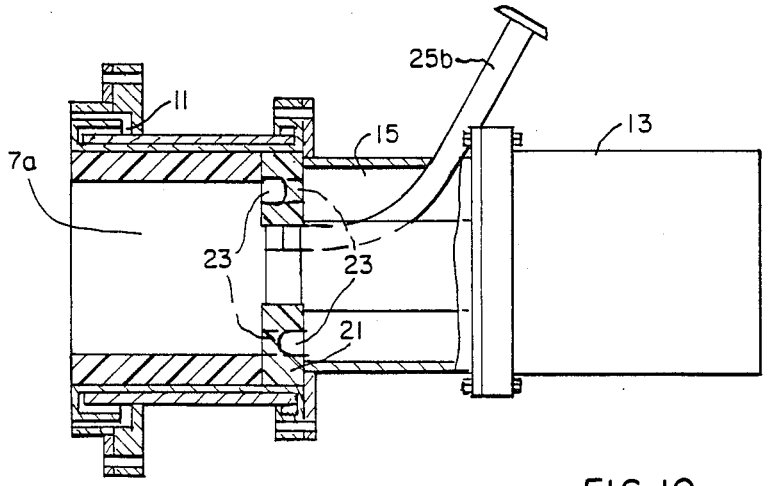
FIG. 10 is a sectional view taken on line X-X of FIG. 9.

In FIGS. 9 and 10, the feed nozzles 25b enter through the separator 21 generally above the plasma nozzle 19 and are generally parallel to the axis of the mixing chamber as they extend adjacent thereto.

The plasma feed nozzles hereinbefore described advantageously provide for the introduction of an extremely high temperature superheated gas in a confined space in which feed material can be rapidly heated and yet the refractory walls are relatively cool providing reasonable lengths of service.

What is claimed is:

1. A plasma feed nozzle for a furnace, said plasma feed nozzle comprising:

a plasma torch for producing a superheated gas at a temperature in the range of 10,000° F. (5538° C.);

a conduit for shroud gas;

a tubular mixing chamber in fluid communication with said superheated gas and said conduit for shroud gas and having one end thereof open to said furnace;

said tubular mixing chamber being lined with a refractory material and being generally encircled by a cooling fluid jacket;

means for introducing said shroud gas from said conduit into said mixing chamber disposed to cooperate with said plasma torch and said mixing chamber so that the superheated gas enters the mixing chamber along its central axis and the shroud gas enters the mixing chamber radially outward from the superheated gas and in such a manner whereby the temperature profile of said gases flowing through said mixing chamber is substantially hotter in the central portion of said mixing chamber than adjacent said refractory lining; and a particulate material feed nozzle so disposed in fluid communication with said mixing chamber that the particulate material is introduced into the central portion of the mixing chamber to mix with the hottest superheated gases in the central portion of the mixing chamber prior to entering the furnace.

2. A plasma feed nozzle as set forth in claim 1, wherein the furnace is lined with refractory material and the mixing chamber extends at least partially through the furnace refractory lining.

3. A plasma feed nozzle as set forth in claim 1 wherein the means for introducing shroud gas from the conduit into the mixing chamber comprises a plenum chamber disposed on the end of the mixing chamber opposite the end open to the furance, the plenum chamber being in fluid communication with the shroud gas conduit and the mixing chamber.

4. A plasma feed nozzle as set forth in claim 3, wherein there is an opening between the mixing chamber and the plenum chamber and the plasma torch is so disposed that the portion thereof from which superheated gas is provided is axially aligned with the opening and disposed at least partially within the plenum chamber.

5. A plasma feed nozzle as set forth in claim 4, wherein the portion of the plasma torch from which the superheated gas is provided generally fills the opening between the plenum and mixing chambers and there is a separator wall disposed there between with a plurality of ports disposed radially outwardly of the opening and the ports are oriented to cause the shroud gas to swirl as it enters the mixing chamber.

6. A plasma feed nozzle as set forth in claim 4, wherein the portion of the plasma torch which supplies the superheated gas is disposed adjacent the opening so as to provide an annular space between the portion of the plasma torch which supplies the superheated gas and the opening and the shroud gas conduit is connected to the plenum chamber tangentially whereby the shroud gas swirls in the plenum chamber and as it passes through the annular opening into the mixing chamber.

7. A plasma feed nozzle as set forth in claim 6, wherein the tubular mixing chamber is tapered so that the end open into the furnace is smaller than the end adjacent the plenum chamber.

8. A plasma feed nozzle as set forth in claim 6, wherein the particulate matter feed conduit is connected to the tubular portion of the mixing chamber and is disposed at an angle with respect to the axis of the mixing chamber biasing the particulate material introduced thereby in the direction of the furnace but introducing the particulate material in the central portion of the mixing chamber.

9. A plasma feed nozzle as set forth in claim 8, wherein the particulate material feed nozzle also introduces a carrier gas with the particulate material.

10. A plasma feed nozzle as set forth in claim 9 wherein the angle of the particulate feed conduit is dependent upon the density and size of the particulate material, the carrier gas flow and viscosity and the flow rate of the superheated gas and shroud gas which cooperate to introduce the particulate material into the central portion of the mixing chamber.

11. A plasma feed nozzle as set forth in claim 5, wherein said particulate material feed nozzle is disposed to extend through said plenum chamber and have a discharge portion which is generally parallel to the axis of the feed nozzle and discharge into the central portion of said mixing chamber.

12. A plasma feed nozzle as set forth in claim 5, wherein said particulate material nozzle is generally disposed at the elevation of the axis of the plasma feed nozzle.

13. A plasma feed nozzle as set forth in claim 5, wherein said particulate feed nozzle is generally disposed at the elevation above the axis of the plasma feed nozzle.

14. A plasma feed nozzle as set forth in claim 10, wherein the particulate feed nozzle enters the upper portion of the mixing chamber.

15. A plasma feed nozzle as set forth in claim 11 wherein there are a plurality of particulate feed nozzles entering the upper portion of the mixing chamber.

* * * * *